US010655205B2

(12) United States Patent
Kweon et al.

(10) Patent No.: US 10,655,205 B2
(45) Date of Patent: May 19, 2020

(54) APPARATUS FOR REMOVING TOP DROSS OF PLATING POT

(71) Applicant: POSCO, Pohang-si, Gyeongsangbuk-do (KR)

(72) Inventors: Yong Hun Kweon, Gwangyang-si (KR); Tae In Jang, Gwangju (KR); Yeon Chae Jeung, Gwangyang-si (KR)

(73) Assignee: POSCO, Pohang-si, Gyeongsangbuk-Do (KR)

( * ) Notice: Subject to any disclaimer, the term of this patent is extended or adjusted under 35 U.S.C. 154(b) by 344 days.

(21) Appl. No.: 15/539,660

(22) PCT Filed: Dec. 21, 2015

(86) PCT No.: PCT/KR2015/014018

§ 371 (c)(1),
(2) Date: Jun. 23, 2017

(87) PCT Pub. No.: WO2016/105047

PCT Pub. Date: Jun. 30, 2016

(65) Prior Publication Data

US 2018/0010225 A1 Jan. 11, 2018

(30) Foreign Application Priority Data

Jun. 30, 2015 (KR) ..... 10-2015-0092927

(51) Int. Cl.
*C23C 2/16* (2006.01)
*C23C 2/06* (2006.01)
(Continued)

(52) U.S. Cl.
CPC ..... *C23C 2/16* (2013.01); *C23C 2/00* (2013.01); *C23C 2/003* (2013.01); *C23C 2/06* (2013.01); *C23C 2/14* (2013.01)

(58) Field of Classification Search
None
See application file for complete search history.

(56) References Cited

U.S. PATENT DOCUMENTS

2014/0329033 A1* 11/2014 Anderhuber ..... C23C 2/003 427/598
2014/0356548 A1* 12/2014 Jang ..... C23C 2/20 427/547

FOREIGN PATENT DOCUMENTS

DE 102006030914 A1 1/2008
JP 54033234 * 8/1979
(Continued)

OTHER PUBLICATIONS

English translation of JP54033234 (Year: 1979).*
(Continued)

*Primary Examiner* — Charles Capozzi
(74) *Attorney, Agent, or Firm* — Morgan, Lewis & Bockius LLP

(57) ABSTRACT

The present invention relates to an apparatus for removing top dross of a plating pot where a snout and an air knife are arranged, the snout being arranged between the front end region and the rear end region of a plating pot. The present invention provides an apparatus for removing top dross of a plating pot, the apparatus comprising: a first wiping means which is mounted on the plating pot and is arranged between the snout and the air knife so as to be movable in the width direction of the plating pot; a second wiping means which is mounted on the plating pot and is rotatably arranged between the air knife and the first wiping means so as to transfer, to the rear end region, the top dross transferred by the first wiping means; and a third wiping means which is mounted on the plating pot and is rotatably arranged between the air knife and the front end region so as to
(Continued)

transfer the top dross to the front end region. Thereby, the present invention provides an advantageous effect of effectively removing dross.

12 Claims, 13 Drawing Sheets

(51) Int. Cl.
*C23C 2/14* (2006.01)
*C23C 2/00* (2006.01)

(56) References Cited

FOREIGN PATENT DOCUMENTS

| | | | | | |
|---|---|---|---|---|---|
| KR | 10-0831061 | B1 | | 5/2008 | |
| KR | 10-1172065 | B1 | | 8/2012 | |
| KR | 2013-0013791 | A | | 2/2013 | |
| KR | 10-2014-0053720 | A | | 5/2014 | |
| KR | 20140053720 | A | * | 5/2014 | |
| KR | 10-2014-0084778 | A | | 7/2014 | |
| KR | 20140084778 | A | * | 7/2014 | |
| KR | 10-1461739 | B1 | | 11/2014 | |
| WO | WO-2013100518 | A1 | * | 7/2013 | ..... C23C 2/20 |

OTHER PUBLICATIONS

English translation of KR20140053720 (Year: 2014).*
English translation of KR20140084778 (Year: 2014).*
Extended European Search Report dated Oct. 19, 2017 issued in European Patent Application No. 15873574.6.
International Search Report and Written Opinion issued in International Patent Application No. PCT/KR2015/014018, dated Apr. 1, 2016; with partial English translation.

* cited by examiner

APPARATUS FOR REMOVING TOP DROSS OF PLATING POT

RELATED APPLICATIONS

This application is the U.S. National Phase under 35 U.S.C. § 371 of International Patent Application No. PCT/KR2015/014018, filed on Dec. 21, 2015, which in turn claims the benefit of Korean Patent Application Nos. 10-2014-0190171, filed on Dec. 26, 2014, and 10-2015-0092927, filed on Jun. 30, 2015, the disclosures of which Applications are incorporated by reference herein.

TECHNICAL FIELD

The present invention relates to an apparatus for removing top dross of a plating pot, and more particularly, to an apparatus for removing top dross of a plating pot, capable of automatically removing dross present while floating on a break surface of the plating pot during a consecutive melted zinc plating process.

BACKGROUND ART

A steel plate is continuously thermally treated in a heating furnace to remove residual stress and passes through melted zinc in a plating pot to be plated while remaining at an adequate temperature. The steel plate passes through a sink roll and a stabilizing roll provided in the plating pot and then passes by air knives disposed above the plating pot. A plating amount of the steel plate is adjusted to be a desired plating amount by a consumer through the air knives.

When the steel plate passes through the air knives, not only zinc scattering but also top dross that is zinc oxide on a break surface of the plating pot are formed due to a high-pressure gas injected from the air knives and oxidation of a melted zinc plating layer attached to a surface of the steel plate. When the top dross is attached to a surface of a transferred steel plate, surface defects such as stabbed dross are caused. Accordingly, it is very important to efficiently remove top dross.

Particularly, in operating at a high speed of 160 mpm or more, since an amount of generated top dross rapidly increases and then a worker should focus on an operation of manually removing the top dross 60% to 70% or more of overall operation, there is a problem in which workability is notably reduced.

DISCLOSURE OF INVENTION

Technical Problem

Accordingly, it is an aspect of the present invention to provide an apparatus for removing top dross of a plating pot, capable of automatically removing the top dross of the plating pot without handwork of a worker.

Particularly, it is another aspect of the present invention to provide an apparatus for removing top dross of a plating pot, capable of effectively removing dross in an area of the plating pot where a dross removing robot can not reach.

Aspects of the present invention will not be limited to the above-described and others not set forth above will be definitely understood by those skilled in the art from the following description.

Technical Solution

According to one aspect of the present invention, there is provided an apparatus for removing top dross of a plating pot in which a snout and air knives are arranged between a front end area and a rear end area of the plating pot, including a first wiping means mounted in the plating pot and disposed between the snout and the air knives to be movable in a lateral direction of the plating pot, a second wiping means mounted in the plating pot and disposed between the air knives and the first wiping means to be pivotable to transfer top dross transferred by the first wiping means to the rear end area, and a third wiping means mounted in the plating pot and disposed between the air knives and the front end area to be pivotable to transfer top dross to the front end area.

The first wiping means may include a magnetic wheel.

The first wiping means may include a body that supports the magnetic wheel to be rotatable, a first driving portion combined with the body to rotate the magnetic wheel, a guide rail disposed in the lateral direction of the plating pot and with which the body is movably combined, a second driving portion that provides a driving force to the body, and an elevating portion combined with the body to elevate the body.

The second wiping means may be disposed on one side based on a center in the lateral direction of the plating pot, and the third wiping means may be disposed on the other side based on the center in the lateral direction of the plating pot.

The second wiping means may be disposed at a corner of the plating pot.

The third wiping means may be disposed at a corner of the plating pot.

The second wiping means and the third wiping means may include magnetic wheels.

The second wiping means and the third wiping means may include first bodies that support the magnetic wheels to be rotatable, first driving portions combined with the first bodies to rotate the magnetic wheels, and second driving portions combined with the first bodies to rotate the first bodies to allow the magnetic wheels to pivot.

The second wiping means and the third wiping means may further include second bodies including the second driving portions and elevating portions that elevate the second bodies.

An axial direction of the magnetic wheel and an axial direction of the first body may be perpendicular.

An axial direction of the first driving portion and an axial direction of the second driving portion may be perpendicular.

The magnetic wheel may include a shaft and a magnet combined with an outer circumferential surface of the shaft.

The apparatus may include a housing that covers the magnetic wheel.

The housing may be formed in a frame shape that surrounds the magnetic wheel to allow the magnetic wheel to be rotatably combined therewith and may include a body combined with the first body, an upper cover combined with an open top surface of the body, and a lower cover combined with an open bottom surface of the body.

The lower cover may include a cylindrical surface corresponding to a surface of the magnetic wheel.

The upper cover and the lower cover may be formed of a stainless material through which uplift force and drag of the magnetic wheel penetrate.

The first body, the second body, and the third body may each include an inlet and an outer connected to the outside, and the apparatus may further include a supply tube connected to the inlets and a cooling fluid supplier connected to the supply tube to supply a cooling fluid to the supply tube.

The supply tube may be formed of a flexible material and may include a vortex inducement means that induces a vortex of the cooling fluid, in the supply tube.

Advantageous Effects

According to one embodiment of the present invention, a wiping means that pushes top dross from an area of a plating pot where a dross removing robot can not reach is provided and transfers the top dross to an area where the dross removing robot reach to effectively remove the top dross.

Also, according to one embodiment of the present invention, a second wiping means and a third wiping means disposed at corners of the plating pot and configured to pivot are provided to effectively remove top dross in areas of the plating pot where the dross removing robot can not reach.

Also, according to one embodiment of the present invention, a magnetic wheel that generates uplift force or drag is used to effectively push top dross.

Also, according to one embodiment of the present invention, a housing that covers the magnetic wheel but transmit the uplift force and drag is provided to prevent zinc of the plating pot from being attached to a surface of the magnetic wheel.

Also, according to one embodiment of the present invention, a cooling means that supplies a cooling fluid to the inside of a body including a motor therein is provided to prevent the motor from being thermally damaged by maintaining uniform internal temperatures of driving portions.

MODE FOR INVENTION

Hereinafter, exemplary embodiments of the present disclosure will be described in detail with reference to the attached drawings. Aspects, specified advantages, and novel features of the present invention will become obvious from a following detailed description and the exemplary embodiments in relation to the attached drawings. Also, the terms used in the specification and the claims will not be limited to a general or lexical meaning and should be understood as having meanings and concepts in accordance with the technical concept of the present invention based on the principle that the meanings of the terms can be adequately defined to describe the present disclosure of the inventor in the best way. Also, in explaining the present invention, a detailed description of well-known related art that may unnecessarily obscure the essential point of the present invention will be omitted.

The terms including ordinal numbers such as second, first and the like may be used for describing various components. However, the components will not be limited by the terms. The terms are used only for distinguishing one element from others. For example, without departing from the scope of the present invention, a second component may be referred to as a first component, and similarly, the first component may be referred to as the second component. The term "and/or" includes any and all combinations or one of a plurality of associated listed items.

Figure 1:
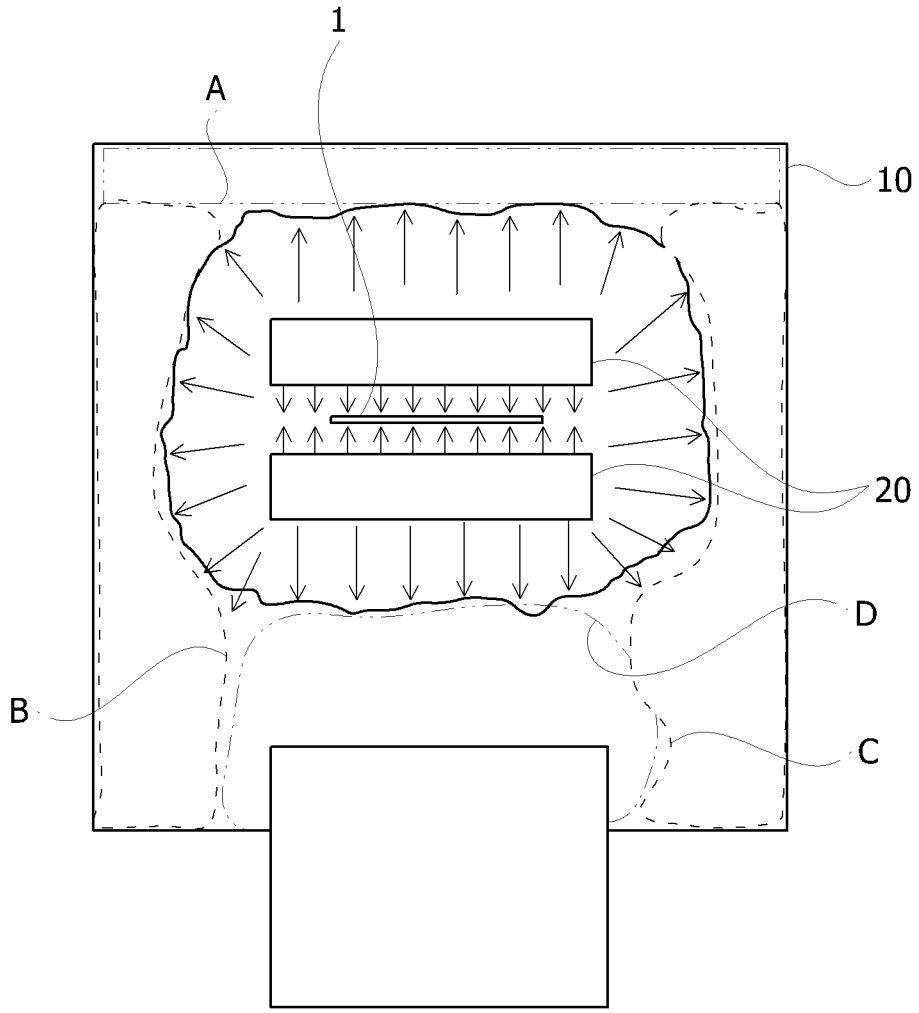
FIG. 1 is a view illustrating distribution of top dross in a plating pot.

FIG. 1 is a view illustrating distribution of top dross in a plating pot.

Referring to FIG. 1, among top dross distributed in a plating pot 10, top dross positioned in area A positioned in front of air knives 20 and or top dross positioned in an area positioned behind a snout may be removed by a dross removing robot. However, it is impossible to remove dross in areas B, C, and D in FIG. 1 using the dross removing robot. Due to interferences of peripheral equipment such as air knives, a sink roll scraper, a pump, a positioner, pipes and the like, it is impossible to install the robot in the areas B, C, and D in FIG. 1.

Due thereto, top dross in the areas B, C, and D in FIG. 1 is manually removed by a worker. Since a peripheral environment of the plating pot is at a high temperature of 460° C., the worker is exposed to a very dangerous working environment in which actually negligent accidents may frequently occur.

Accordingly, to fundamentally solve the problem, an apparatus for removing top dross in a plating pot according to one embodiment of the present invention is provided to move top dross positioned in an area where the dross removing robot can not reach to an area where the dross removing robot reaches.

Hereinafter, the apparatus for removing top dross in a plating pot according to one embodiment of the present invention will be described in detail with reference to the attached drawings.

Figure 2:
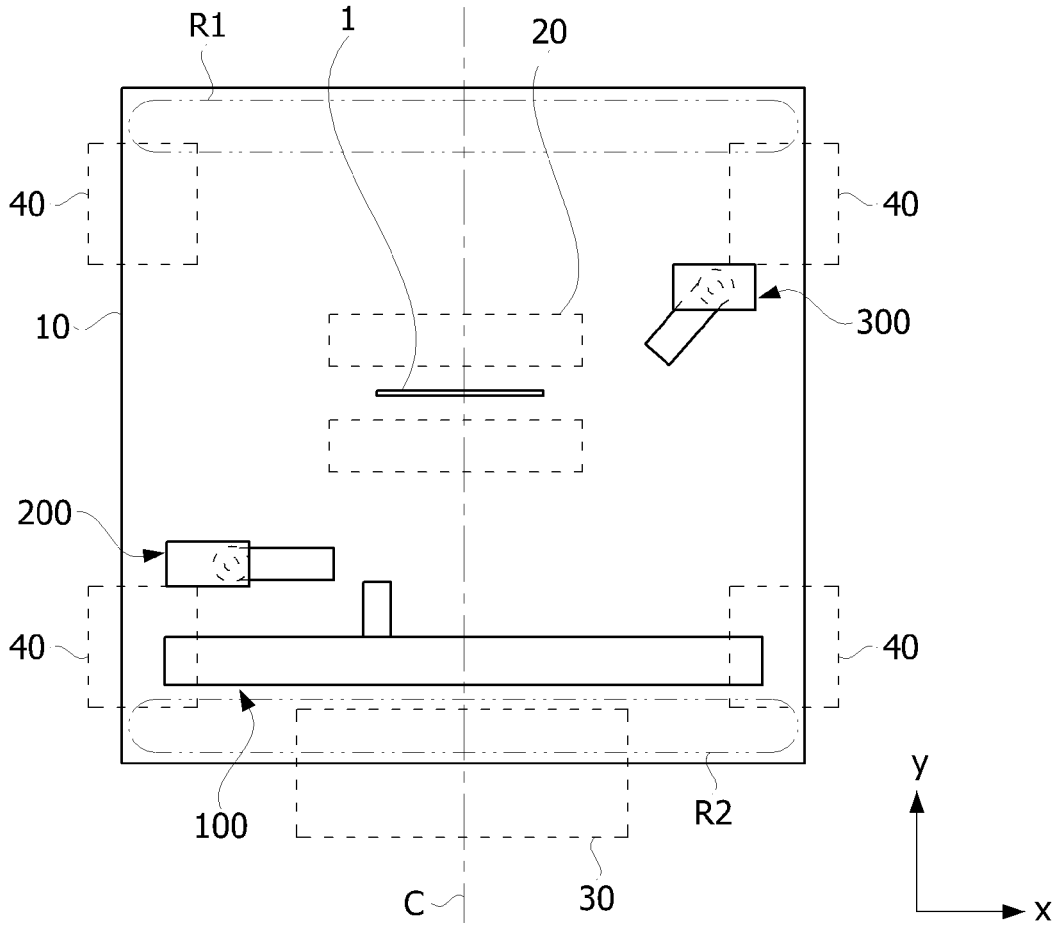
FIG. 2 is a view illustrating an apparatus for removing top dross of a plating pot according to one exemplary embodiment of the present invention.
Figure 3:
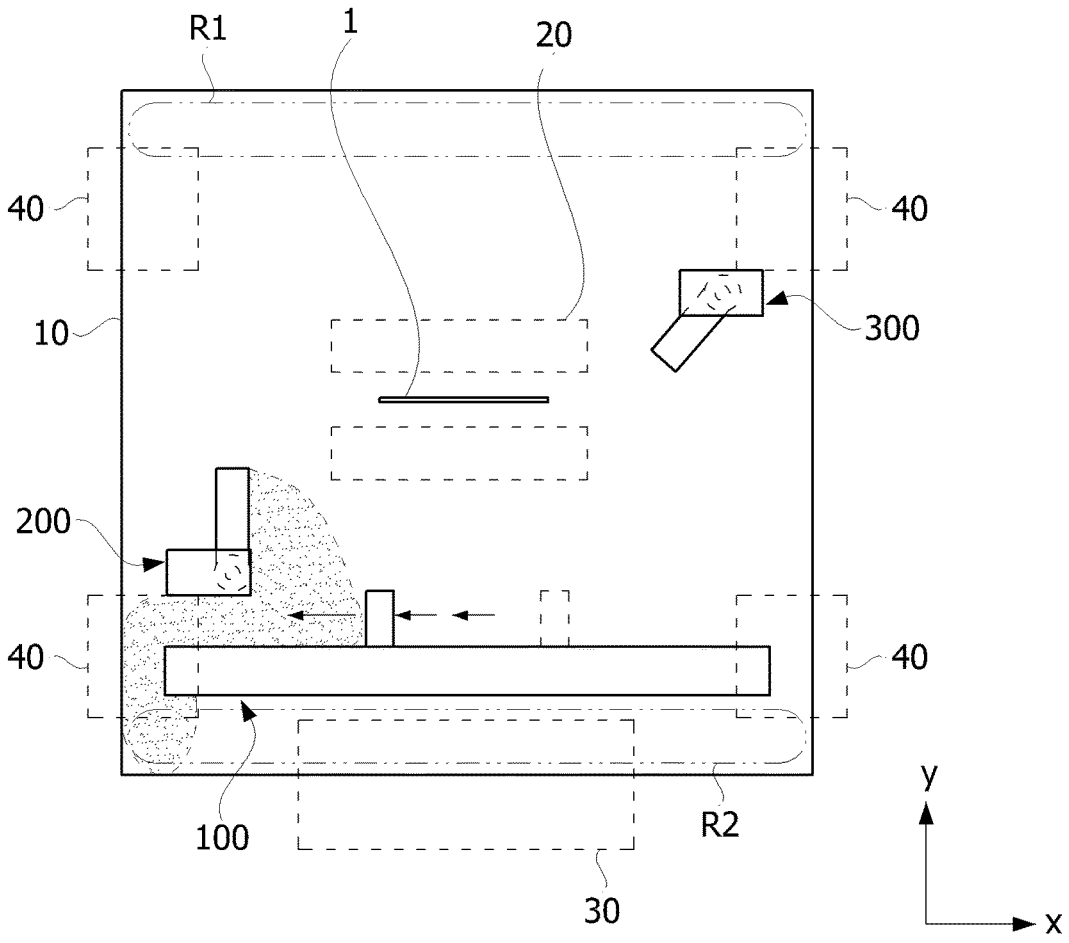
FIG. 3 is a view illustrating a state in which top dross is transferred by a first wiping means.

FIG. 2 is a view illustrating an apparatus for removing top dross of a plating pot according to one exemplary embodiment of the present invention, and FIG. 3 is a view illustrating a state in which top dross is transferred by a first wiping means. FIGS. 2 and 3 definitely illustrate main feature parts to understand the concept of the present invention, and in result, various modifications of diagrams are expected and it is unnecessary to limit the scope of the present invention to particular shapes shown in the drawings.

Referring to FIGS. 2 and 3, the apparatus for removing top dross in a plating pot according to one exemplary embodiment of the present invention may include a first wiping means 100, a second wiping means 200, and a third wiping means 300.

First, in describing the present invention, an x-axis direction shown in FIG. 2 will be defined as a lateral direction of the plating pot 10 and a y-axis direction shown in FIG. 2 will be defined as a longitudinal direction of the plating pot 10. A part of a front sidewall of the plating pot 10 positioned ahead based on the longitudinal direction of the plating pot 10 will be defined as a front end area R1 of the plating pot 10, and a part of a rear sidewall of the plating pot 10 positioned behind based on the longitudinal direction of the plating pot 10 will be defined as a rear end area R2 of the plating pot 10.

The first wiping means 100 may be disposed lengthwise in the x-axis direction of the plating pot 10 between the air knives 20 and the snout 30 based on the y-axis direction. The first wiping means 100 linearly reciprocates in the x-axis direction to transfer top dross in front of the snout 30 to both sides of the plating pot 10.

The second wiping means 200 may be disposed between the first wiping means 100 and the air knives 20 based on the y-axis direction. Also, the second wiping means 200 may be disposed on a left side in the drawing based on a virtual vertical reference line C that passes through a center in the lateral direction (the x-axis direction). Particularly, the second wiping means 200 may be disposed adjacent to the first wiping means 100 rather than the air knives 20 based on the y-axis direction and may be disposed adjacent to an end of the first wiping means 100 based on the x-axis direction.

Also, the second wiping means 200 is configured to rotate and guides the top dross transferred by the first wiping means 100 to the rear end area R2 of the plating pot 10.

Since a working radius of the dross removing robot reaches the rear end area R2 of the plating pot 10, the top dross may be automatically removed using the robot.

The third wiping means 300 may be disposed between the front end area R1 of the plating pot 10 and the air knives 20 based on the y-axis direction. Also, the third wiping means 300 may be disposed on a right side in the drawing based on the vertical reference line C. Particularly, the third wiping means 300 may be disposed adjacent to the air knives 20 rather than the front end area R1 based on the y-axis direction and may be disposed near a right corner of the plating pot 10.

The first wiping means 100, the second wiping means 200, and the third wiping means 300 guide top dross of the plating pot 10 to the front end area R1 and the rear end area R2 reached by the working radius of the dross removing robot, and a detailed working state thereof is as follows.

Referring to FIG. 3, the first wiping means 100 linearly moves in the lateral direction of the plating pot 10 and pushes top dross positioned between the snout 30 and the air knives 20 toward a side surface of the plating pot 10, that is, a position where the second wiping means 200 is disposed. The first wiping means 100 repeats linear movement to continuously push top dross toward the second wiping means 200.

Figure 4:
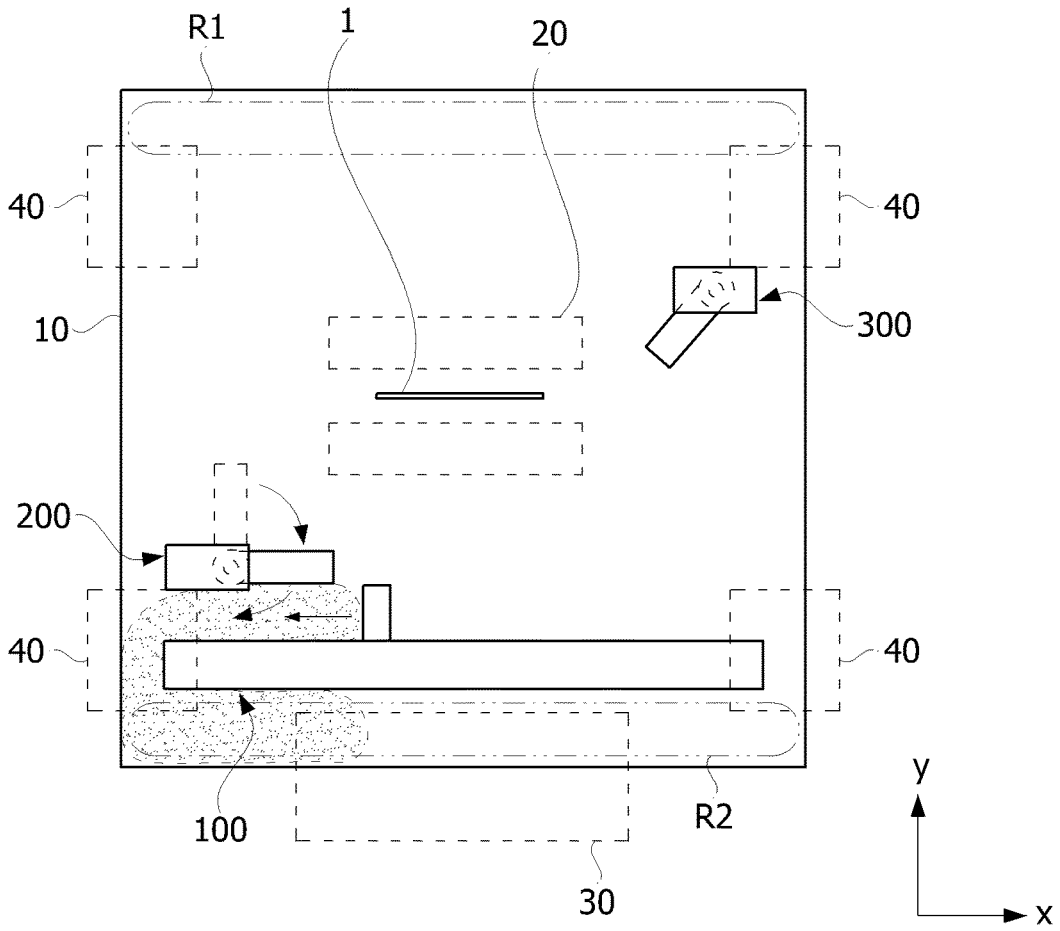
FIG. 4 is a view illustrating a state in which top dross is transferred by a second wiping means.

FIG. 4 is a view illustrating a state in which top dross is transferred by the second wiping means.

After that, for example, as shown in FIG. 4, when the second wiping means 200 pivots clockwise, the top dross transferred by the first wiping means 100 is pushed toward the rear end area R2. The top dross pushed by the second wiping means 200 to the rear end area R2 may be automatically removed by the dross removing robot.

Figure 5:
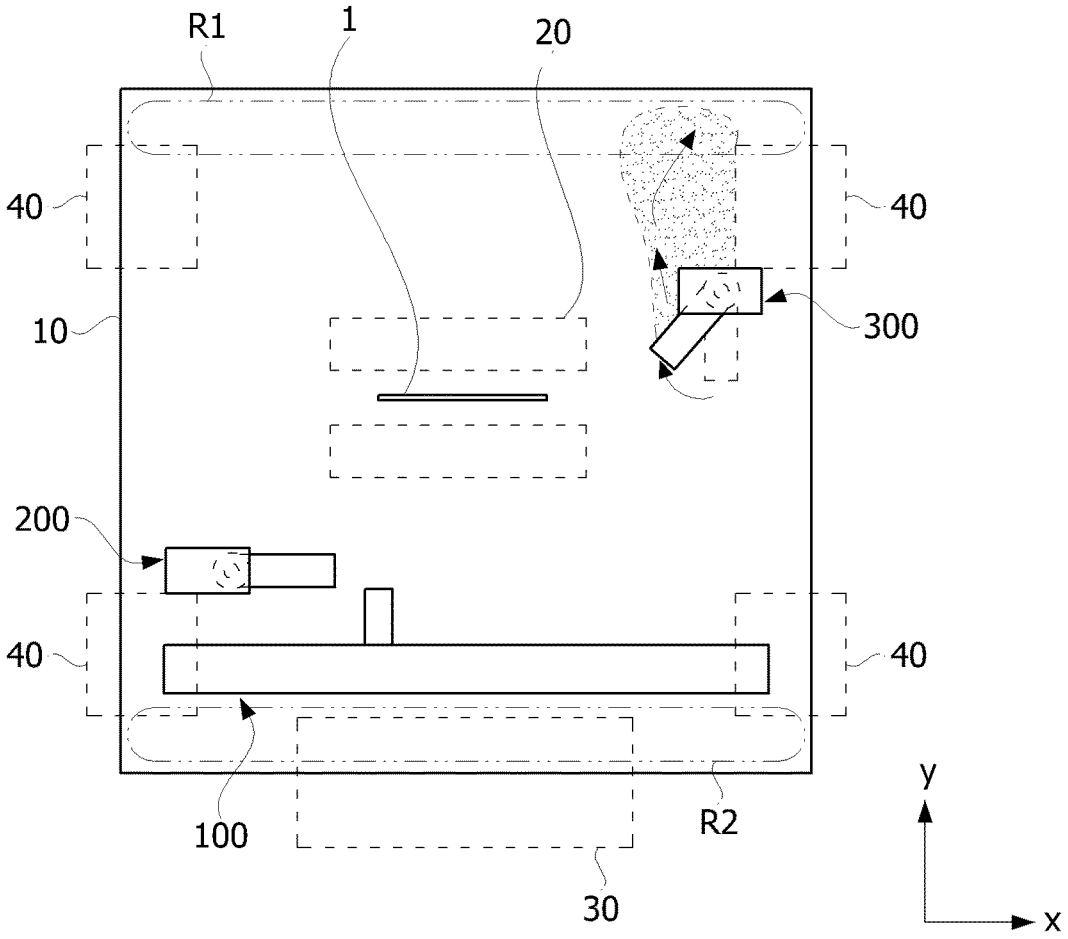
FIG. 5 is a view illustrating a state in which top dross is transferred by a third wiping means.

FIG. 5 is a view illustrating a state in which top dross is transferred by the third wiping means.

Meanwhile, for example, as shown in FIG. 5, when the third wiping means 300 pivots clockwise, top dross around the air knives 20 is pushed toward the front end area R1. The top dross pushed by the third wiping means 300 to the front end area R1 may be automatically removed by the dross removing robot.

Next, with reference to the drawings, configurations of the first wiping means 100, the second wiping means 200, and the third wiping means 300 will be described in detail.

Figure 6:
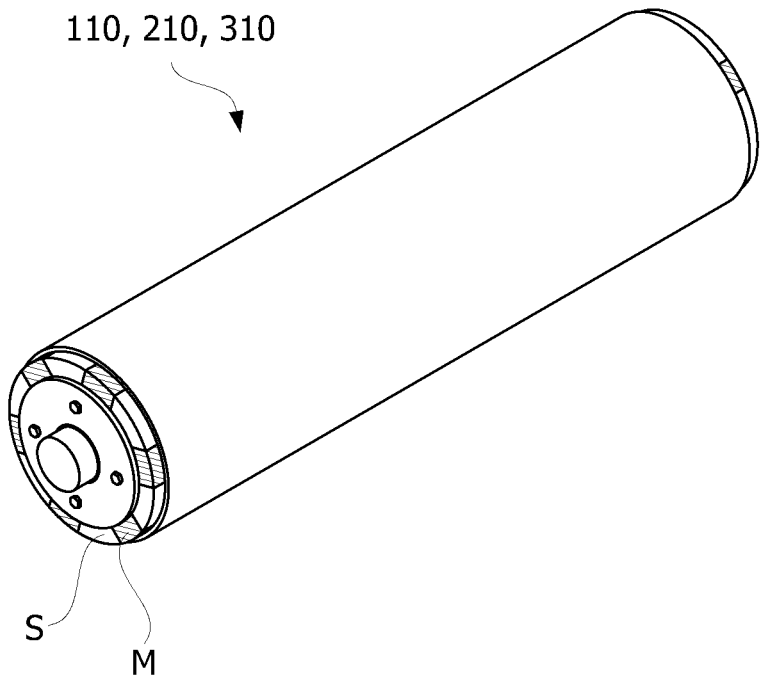
FIG. 6 is a view of a magnetic wheel.
Figure 7:
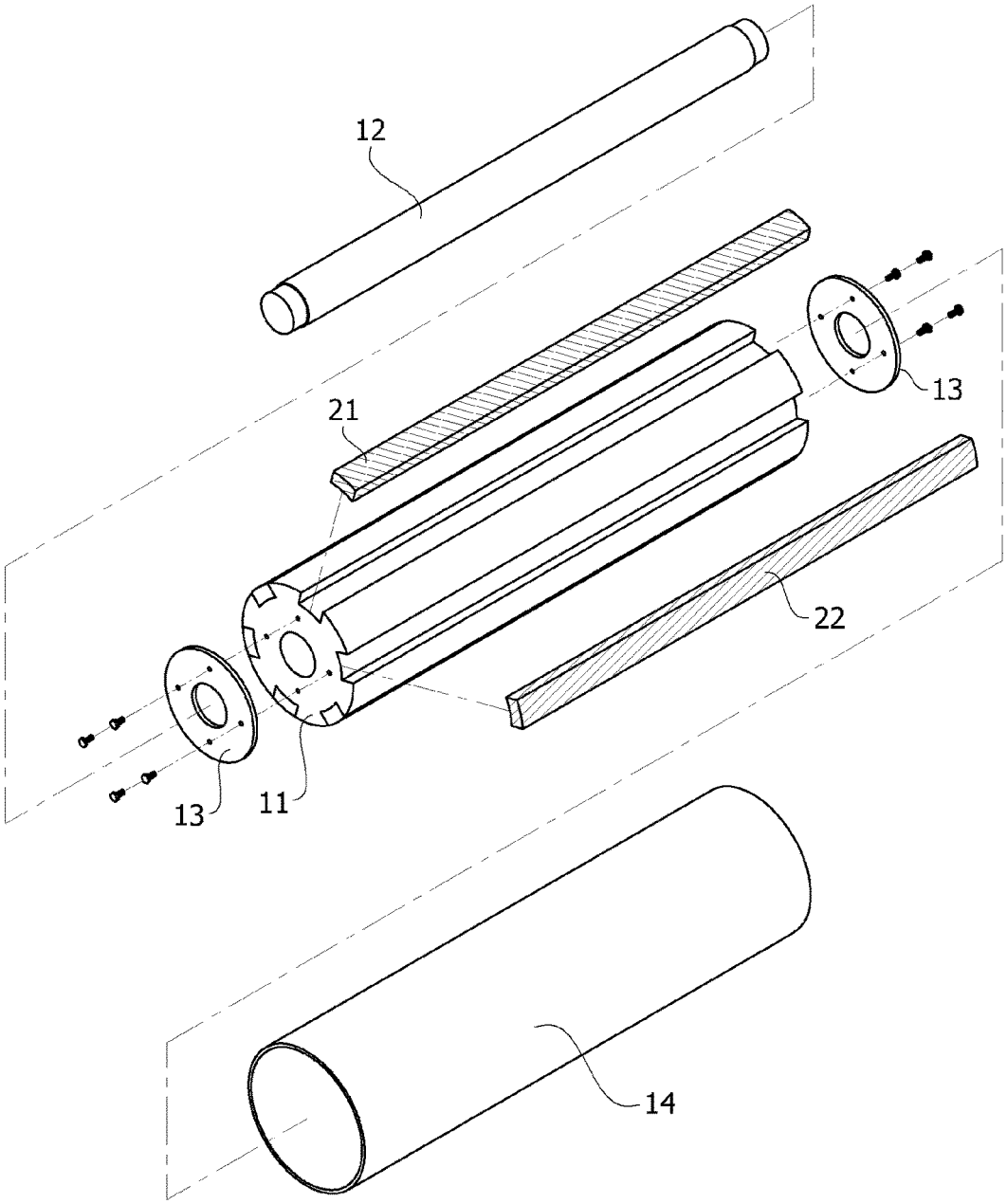
FIG. 7 is an exploded view of the magnetic wheel shown in FIG. 6.
Figure 8:
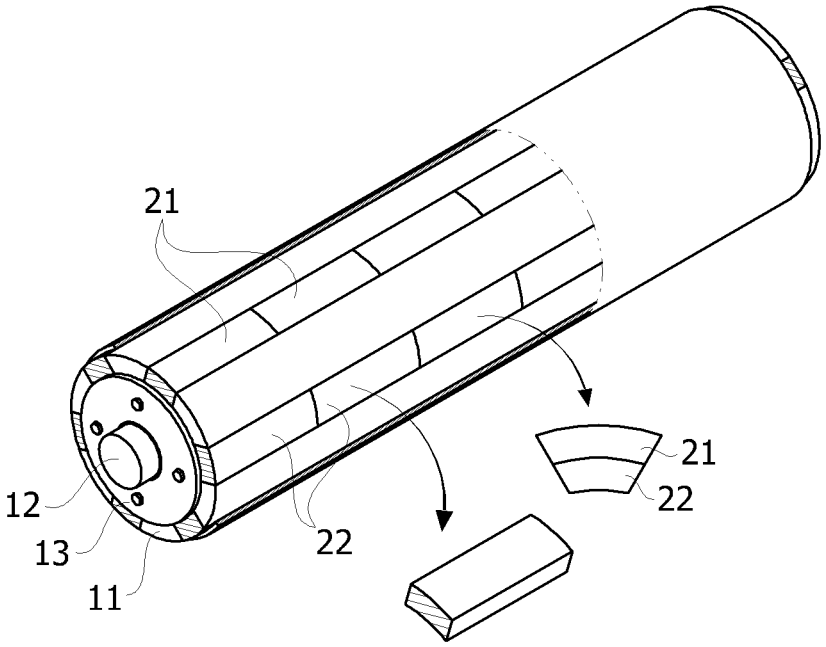
FIG. 8 is a view illustrating stacked and arranged magnets.

FIG. 6 is a view of a magnetic wheel, FIG. 7 is an exploded view of the magnetic wheel shown in FIG. 6, and FIG. 8 is a view illustrating stacked and arranged magnets.

The first wiping means 100, the second wiping means 200, and the third wiping means 300 may include magnetic wheels 110, 210, and 310.

Referring to FIGS. 6 and 7, each of the magnetic wheels 110, 210, and 310 may include a shaft S and magnets M combined with an outer circumferential surface of the shaft S. The magnets M are disposed on the shaft S to allow the magnets M having N pole and S pole to deviate from each other to push top dross of the plating pot 10 through a repulsive force and drag force generated at high speed rotation.

In detail, as shown in FIGS. 6 and 7, the magnetic wheels 110, 210, and 310 may each include a wheel block 11 and a shaft 12. The wheel block 11 is formed of a cylindrical rotation body and may include a hollow in a center to allow the shaft 12 to be inserted therein. Slots may be formed on an outer circumferential surface of the wheel block 11 to be concave and lengthwise in a longitudinal direction. The slots may be arranged at certain intervals based on a circumferential direction of the wheel block 11.

Magnets 21 and 22 are inserted in the slots. The magnets 21 and 22 are disposed to allow a magnet 21 having N pole and a magnet 22 having S pole which are opposite to each other to be alternately arranged along the circumferential direction. An adhesive may be applied to the magnet 22 to increase combinative property.

To fix the magnet 22, a cover 14 that surrounds the outer circumferential surface of the wheel block 11 may be installed. Also, lids 13 may be combined with both side surfaces of the wheel block 11 not to allow the magnet 22 to be separated. Meanwhile, as shown in FIG. 17, the magnets 21 and 22 having opposite poles may be stacked and arranged.

When the magnetic wheels 110, 210, and 310 rotate, top dross that is a diamagnetic body is rasped by uplift force and drag and is pushed. Here, the uplift force acts perpendicularly to a break surface of the plating pot 10 and the drag acts horizontally to the break surface of the plating pot 10.

Figure 9:
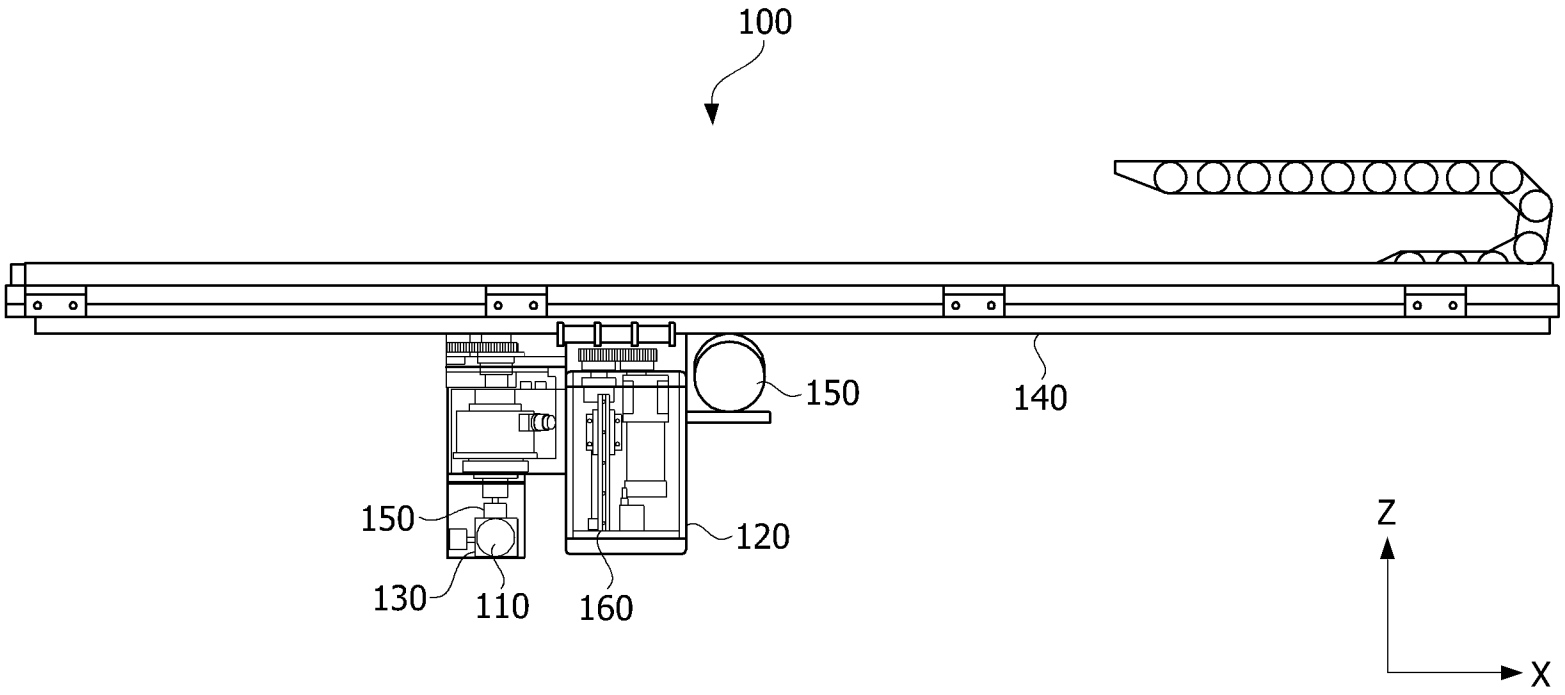
FIG. 9 is a view of the first wiping means.

FIG. 9 is a view of the first wiping means.

Referring to FIG. 9, the first wiping means 100 may include a body 120 that supports the magnetic wheel 110, a first driving portion 130, a guide rail 140, and a second driving portion 150.

The first driving portion 130 rotates the magnetic wheel 110. The first driving portion 130 may be directly connected to a rotating shaft of the magnetic wheel 110 or may transfer torque to the magnetic wheel 110 through an additional power transfer member. The first driving portion 130 may be formed of a servomotor to adequately control rotation speed of the magnetic wheel 110.

The body 120 may be slidably combined below the guide rail 140. The guide rail 140 may be disposed lengthwise along the lateral direction of the plating pot 10. Also, the guide rail 140 may be combined with a sink roll supporter 40 (refer to FIG. 2) of the plating pot 10. A rack gear may be installed lengthwise at the guide rail 140.

The second driving portion 150 provides a driving force to allow the body 120 to be movable along the guide rail 140. A motor and a pinion gear combined with a rotating shaft of the motor may be provided at the second driving portion 150. Here, the pinion gear may be formed to be engaged with the rack gear formed at the guide rail 140.

An elevating portion 160 adjusts a height of the magnetic wheel 110 by elevating the body 120 in a height direction of the plating pot 10 (a z-axis direction in FIG. 9). The elevating portion 160 includes an elevating motor and a linear motor (LM) guide disposed in the z-axis direction and may include power transfer members such as a gear assembly that transfers power of the motor.

Figure 10:
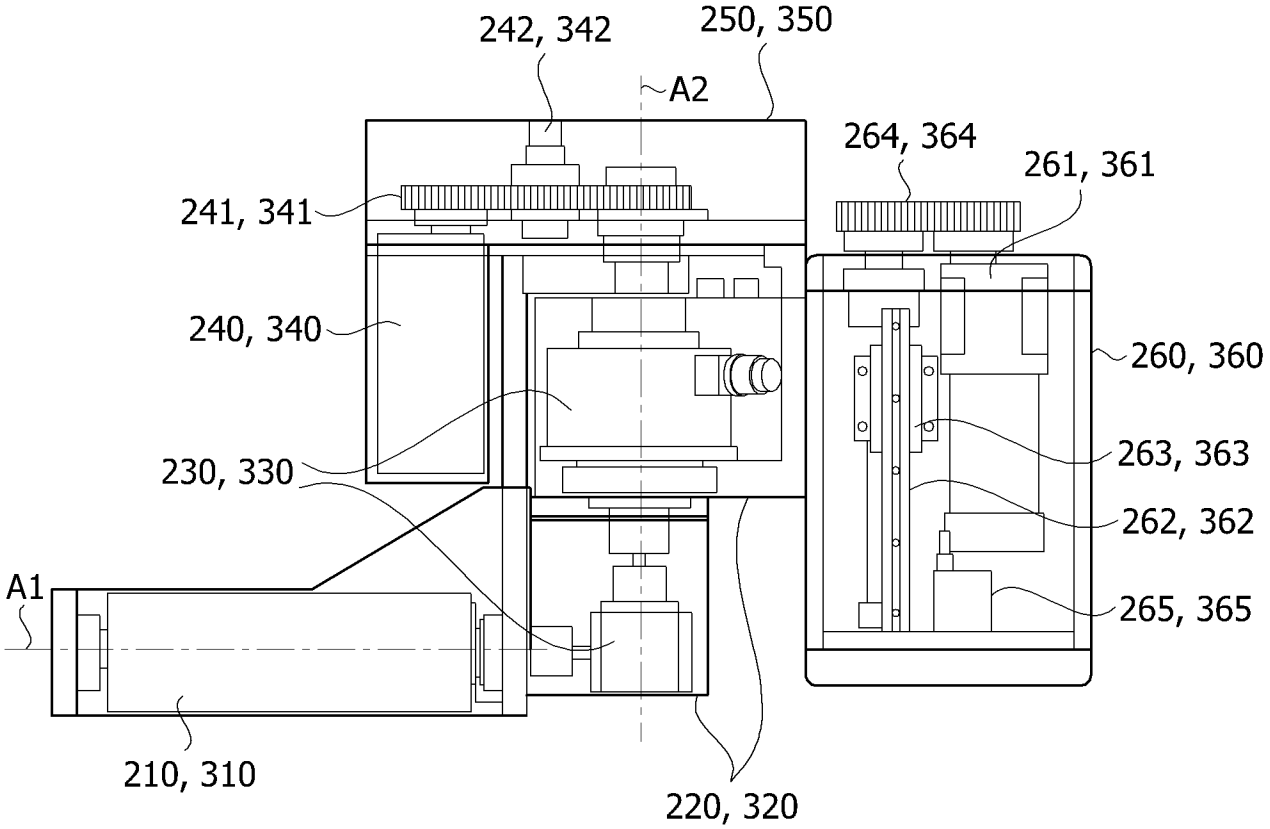
FIG. 10 is a view illustrating the second wiping means and the third wiping means.

FIG. 10 is a view illustrating the second wiping means and the third wiping means.

Referring to FIG. 10, the second and third wiping means 200 and 300 may include the magnetic wheels 210 and 310, first driving portions 230 and 330 that rotate the magnetic wheels 210 and 310, and second driving portions 240 and 340 that pivot the magnetic wheels 210 and 310.

The magnetic wheels 210 and 310 are supported by first bodies 220 and 320. The magnetic wheels 210 and 310 are arranged at the first bodies 220 and 320 to be rotatable around a rotating shaft A1 (refer to FIG. 8). The first driving portions 230 and 330 may be provided in the first bodies 220 and 320. The first driving portions 230 and 330 rotate the magnetic wheels 210 and 310 around the rotating shaft A1 of FIG. 8. The first driving portions 230 and 330 may be formed of servomotors to adequately control rotation speed of the magnetic wheels 210 and 310.

The second driving portions 240 and 340 are included in second bodies 250 and 350 and rotate the magnetic wheels 210 and 310 around a rotating shaft A2 (refer to FIG. 8) of the first bodies 220 and 320. Here, the rotating shaft A1 of the magnetic wheels 210 and 310 and the rotating shaft A2 of the first bodies 220 and 320 may be perpendicularly formed. Also, a rotating shaft of the motor of the second driving portions 240 and 340 may be disposed in parallel with the rotating shaft A2 of the first bodies 220 and 320.

Also, the second driving portions 240 and 340 may transfer torque to the first bodies 220 and 320 through power transfer members 241 and 341 such as gear assemblies. Rotation angle sensors 242 and 342 that measure rotation angles of the first bodies 220 and 320 may be provided at the second bodies 250 and 350.

Elevating portions 260 and 360 are included in third bodies 260 and 360 and elevate the second bodies 250 and 350. When the second bodies 250 and 350 are elevated, heights of the magnetic wheels 210 and 310 are adjusted based on the height direction of the plating pot 10.

The above-described elevating portions 260 and 360 may include elevating motors 261 and 361, rail guides 262 and 362, ball screws 263 and 363, and power transfer members 264 and 364.

The ball screws 263 and 363 are connected to the second bodies 250 and 350 and connected to the elevating motors 261 and 361. When the ball screws 263 and 363 rotate, the second bodies 250 and 350 elevate the rail guides 262 and 362. Here, the elevating portions 260 and 360 may include sensors 265 and 365 capable of measuring elevating positions of the second bodies 250 and 350.

The above-described second and third wiping means 200 and 300 may be mounted on the sink roll supporter 40 (refer to FIG. 2) of the plating pot 10.

Figure 11:
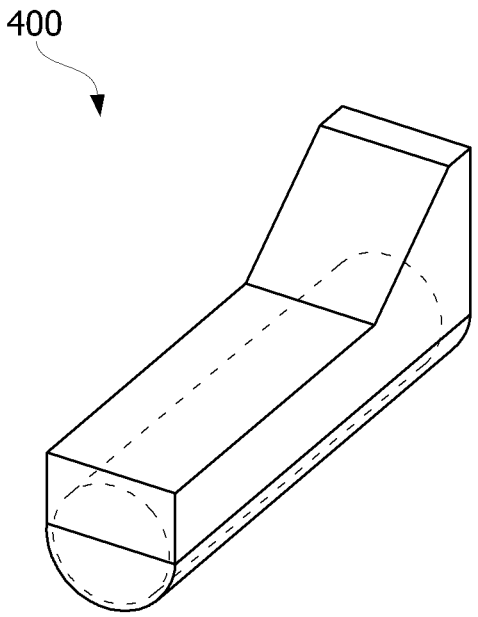
FIG. 11 is a view illustrating a housing of the magnetic wheel.
Figure 12:
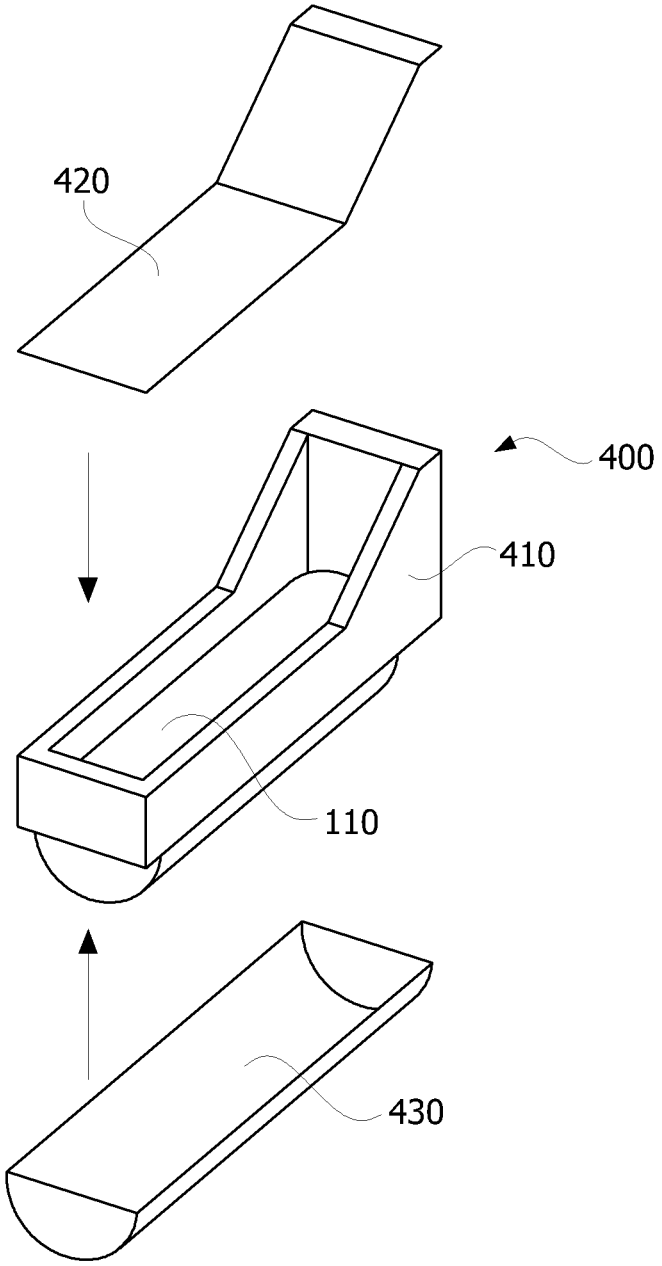
FIG. 12 is an exploded view of the housing shown in FIG. 11.

FIG. 11 is a view illustrating a housing of the magnetic wheel, and FIG. 12 is an exploded view of the housing shown in FIG. 11.

Referring to FIGS. 11 and 12, the magnetic wheel may be protected by an additional housing 400. The housing 400 may include a body 410, an upper cover 420, and a lower cover 430.

The body 410 may be formed of a frame shape that surrounds the magnetic wheel 110. Also, the body 410 may rotatably fix the magnetic wheel 110. The body 410 may be fixedly combined with the first bodies 220 and 320. Meanwhile, the body 410 has a shape with open top and bottom. This is a configuration for transferring uplift force and drag of the magnetic wheel 110 to top dross of the plating pot 10.

However, since the magnetic wheels 210 and 310 are exposed outside, zinc that pops out from the break surface of the plating pot 10 may be attached to surfaces of the magnetic wheels 210 and 310. When a mass of zinc attached to the surfaces of the magnetic wheels 210 and 310 sets hard, it becomes an obstacle held by an inner surface of the body 410 and interferes in rotation of the magnetic wheels 210 and 310.

Accordingly, the upper cover 420 may be provided at an open top surface of the body 410 and the lower cover 430 may be provided at an open bottom surface thereof. The upper cover 420 may be formed in a flat plate shape and be bolt-combined to cover the top surface of the body 410. Also, the lower cover 430 may be formed to have a cylindrical surface corresponding to shapes of the surfaces of the magnetic wheels 210 and 310 and be bolt-combined to cover the bottom surface of the body 410.

When the upper cover 420 is combined with the top of the body 410 and the lower cover 430 is combined with the bottom thereof, the magnetic wheel 110 may be surrounded overall by the body 410, the upper cover 420, and the lower cover 430 to be protected from the zinc that pops out of the break surface of the plating pot 10.

Here, the upper cover 420 and the lower cover 430 may be formed of a stainless material which transmits the uplift force and drag of the magnetic wheel 110. As an example, the upper cover 420 and the lower cover 430 may be formed of a stainless material such as SUS316L including Ni, Cr, Mo and the like.

The upper cover 420 and the lower cover 430 have been described as separate independent parts in describing the present invention but may be formed as a single connected means.

Figure 13:
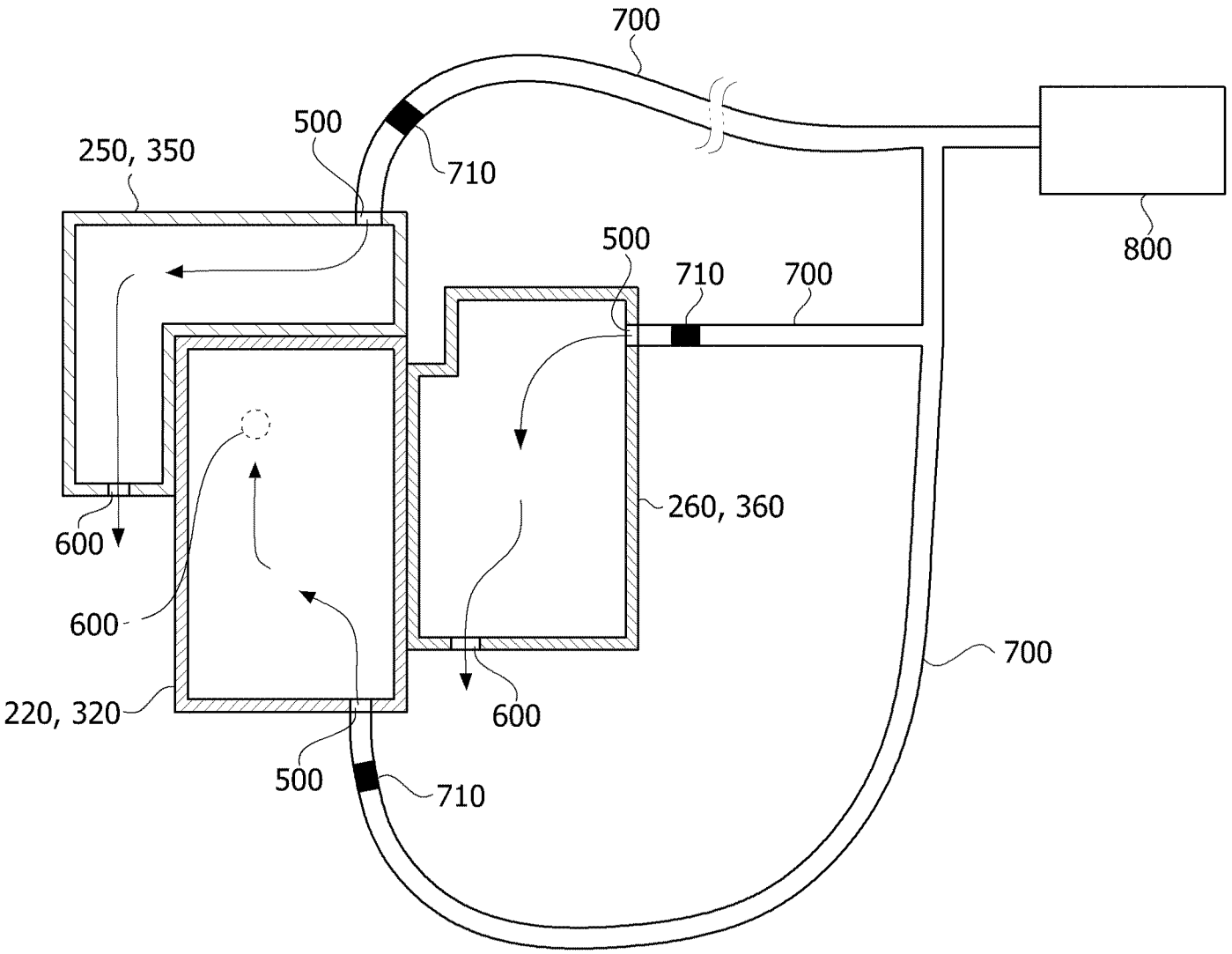
FIG. 13 is a view of a cooling means.

FIG. 13 is a view of a cooling means.

The first wiping means 100, the second wiping means 200, and the third wiping means 300 include motors. Here, since an internal temperature of the plating pot 10 is 460° C. that is a very high temperature environment and an ambient temperature of the plating pot 10 is 100° C. or more, performance of motors is sharply decreased.

The motors and power transfer elements that rotate or pivot the magnetic wheels 110, 210, and 310 may be accommodated in the first bodies 220 and 320, the second bodies 250 and 350, and the third bodies 260 and 360. The first bodies 220 and 320, the second bodies 250 and 350, and the third bodies 260 and 360 have structures capable of shutting out heat from the outside due to sealed spaces formed therein.

Accordingly, as an example, when insulators are installed in inner walls of the first bodies 220 and 320, the second bodies 250 and 350, and the third bodies 260 and 360, thermal damage of the motors may be prevented to a certain degree. Here, the insulators may be formed of glass fiber and may be configured to arrange air layers between fibers to increase an insulating effect.

As another example of preventing the motor from being thermally damaged, a cooling means may be additionally installed.

As cooling means, inlets 500, outlets 600, a supply tube 700, and a cooling fluid supplier 800 may be included.

The inlets 500 and the outlets 600 may be formed at the first bodies 220 and 320, the second bodies 250 and 350, and the third bodies 260 and 360. The inlets 500 and the outlets 600 may be formed at adequate positions to allow a cooling fluid to come into full contact with the motors, considering positions of the motors included in the inner spaces of the first bodies 220 and 320, the second bodies 250 and 350, and the third bodies 260 and 360.

Screw taps are formed on inner circumferential surfaces of the inlet 500 and the outlet 600 to induce the supply tube 700 to be detachably combined.

The supply tube 700 supplies a cooling fluid supplied by the cooling fluid supplier 800 to an inside of each of the first bodies 220 and 320, the second bodies 250 and 350, and the third bodies 260 and 360. The supply tube 700 may be formed of a flexible material. The supply tube 700 connected to the cooling fluid supplier 800 may be diverged to be combined with the inlets 500 of the first bodies 220 and 320, the second bodies 250 and 350, and the third bodies 260 and 360.

A vortex inducement means 710 that induces a vortex of a cooling fluid may be installed in the supply tube 700. The vortex inducement means 710 may have a configuration including a plurality of blades that rotate to change a flow of a cooling fluid. The above-described vortex inducement means 710 increases cooling efficiency by inducing a vortex of a cooling fluid that flows into the inlet 500.

The cooling fluid supplier 800 supplies a cooling fluid to the supply tube 700. The cooling fluid supplier 800 may be an air supplier provided in equipment. Here, a cooling fluid may be air.

The cooling fluid supplied by the cooling means may prevent the motor from being thermally damaged by maintaining uniform temperatures in the first bodies 220 and 320, the second bodies 250 and 350, and the third bodies 260 and 360.

As described above, the apparatus of removing top dross of a plating pot according to one exemplary embodiment of the present invention has been described in detail with reference to the attached drawings.

Although the technical concept of the present invention has been exemplarily described above, various modifications, changes, and replacements may be made by one of ordinary skill in the art without departing from the essential features of the present invention. Accordingly, the embodiment described herein and the attached drawings will not be intended to limit but explain the technical concept of the present invention and the scope of the technical concept of the present invention is not limited to the embodiment and the attached drawings. It will be understood that the scope of the present invention should be defined by the following claims and equivalents thereof should be included in the scope of the present invention.

DESCRIPTION OF REFERENCE NUMERALS

10: Plating pot, 20: Air knives, 30: Snout, 100: First wiping means, 110, 210, 310: Magnetic wheels, 120: Body, 130, 230, 330: First driving portions, 140: Guide rail, 150, 240, 340: Second driving portions, 200: Second wiping means, 220, 320: First bodies, 240, 340: Second driving portions, 250,350: Second bodies, 160, 260, 360: Elevating portions, 300: Third wiping means, 400: Housing, 410: Body, 420: Upper cover, 430: Lower cover, 500: Inlets, 600: Outlets, 700: Supply tube, 800: Cooling fluid supplier

The invention claimed is:

1. An apparatus for removing top dross of a plating pot comprising:

a first magnetic wheel mounted in the plating pot;

a second magnetic wheel mounted in the plating pot; and a third magnetic wheel mounted in the plating pot;

wherein the first magnetic wheel is arranged to linearly reciprocate in the width direction of the plating pot between a snout and air knives based on a longitudinal direction of the plating pot such that a top dross in front of the snout is transferred to both sides of the plating pot, the second magnetic wheel is arranged to be pivotable on one side based on the width direction of the plating pot behind the air knives based on the longitudinal direction of the plating pot, so that the top dross transferred by the first magnetic wheel is transferred around a rear sidewall of the plating pot, and the third magnetic wheel is arranged to be pivotable on the other side based on the width direction of the plating pot in front of the air knives based on the longitudinal direction of the plating pot, so that a top dross in front of and on a side of the air knives is transferred around a front sidewall of the plating pot.

2. The apparatus of claim 1, further including a plurality of motors connected to the first magnetic wheel, the second magnetic wheel and the third magnetic wheel, respectively.

3. The apparatus of claim 1, wherein the second magnetic wheel is disposed on one side based on a virtual reference line that passes a center in the lateral direction of the plating pot, and the third magnetic wheel is disposed on the other side of the reference line.

4. The apparatus of claim 3, wherein the second magnetic wheel is disposed at a corner of the plating pot.

5. The apparatus of claim 4, wherein the third magnetic wheel is disposed at a corner of the plating pot.

6. The apparatus of claim 1, wherein each of the first magnetic wheel, the second magnetic wheel and the third magnetic wheel comprise a shaft and a magnet combined with an outer circumferential surface of the shaft, respectively.

7. The apparatus of claim 2, wherein each of the first magnetic wheel, the second magnetic wheel and the third magnetic wheel comprise a housing that covers each of the magnetic wheels.

8. The apparatus of claim 7, wherein each of the housings are formed in a shape that surrounds the magnetic wheel to allow the magnetic wheel to be rotatably combined therewith and wherein each of the housings comprise a body with an upper cover combined with an open top surface of the body, and a lower cover combined with an open bottom surface of the body.

9. The apparatus of claim 8, wherein the lower cover for each of the magnetic wheels comprises a cylindrical surface corresponding to a surface of each of the magnetic wheels.

10. The apparatus of claim 9, wherein the upper cover and the lower cover for each of the housings are formed of a stainless material through which uplift force and drag for each of the magnetic wheels penetrate.

11. The apparatus of claim 10, further comprising a first body accommodating a motor to rotate the first magnetic wheel, a second body accommodating a motor to rotate the second magnetic wheel and a third body accommodating a motor to rotate the third magnetic wheel, wherein the first body, the second body, and the third body each comprise an inlet and an outer connected to the outside, the apparatus further comprising a supply tube connected to the inlets and a cooling fluid supplier connected to the supply tube to supply a cooling fluid to the supply tube.

12. The apparatus of claim 11, wherein the supply tube is formed of a flexible material and comprises a plurality of blades that induces a vortex of the cooling fluid, in the supply tube.

* * * * *